US006645605B2

(12) United States Patent
Hammersmith et al.

(10) Patent No.: US 6,645,605 B2
(45) Date of Patent: Nov. 11, 2003

(54) MATERIALS AND METHOD OF MAKING SAME FOR LOW IGNITION PROPENSITY PRODUCTS

(76) Inventors: James Rodney Hammersmith, 40 Spring Cove Dr., Brevard, NC (US) 28712; Vaughn Allen Bryson, 211 Island Ford Rd., Brevard, NC (US) 28712

( * ) Notice: Subject to any disclaimer, the term of this patent is extended or adjusted under 35 U.S.C. 154(b) by 0 days.

(21) Appl. No.: 09/760,175

(22) Filed: Jan. 15, 2001

(65) Prior Publication Data

US 2002/0129824 A1 Sep. 19, 2002

(51) Int. Cl.[7] ..... B32B 27/14

(52) U.S. Cl. ..... 428/198; 428/412; 428/537.5; 162/139; 131/365

(58) Field of Search ..... 428/198, 412, 428/474.4, 534, 535, 537.5; 162/139, 157.1, 157.6, 168.3, 158; 131/365, 332, 358, 364, 345, 349, 256

(56) References Cited

U.S. PATENT DOCUMENTS

| | | | | |
|---|---|---|---|---|
| 1,996,002 A | | 3/1935 | Seaman | 131/52 |
| 1,999,222 A | | 4/1935 | Weinberger | 131/52 |
| 2,013,508 A | | 9/1935 | Seaman | 131/52 |
| 2,666,437 A | | 1/1954 | Lattof | 131/4 |
| 2,775,970 A | | 1/1957 | Schoenbaum et al. | 131/15 |
| 3,030,963 A | | 4/1962 | Cohn | 131/4 |
| 3,872,871 A | * | 3/1975 | Fiore et al. | 131/140 P |
| 3,911,932 A | | 10/1975 | Houck, Jr. et al. | 131/15 B |
| 4,044,778 A | | 8/1977 | Cohn | 131/365 |
| 4,077,414 A | | 3/1978 | Baker et al. | 131/8 |
| 4,230,131 A | | 10/1980 | Simon | 131/4 A |
| 4,303,084 A | | 12/1981 | Simon | 131/349 |
| 4,450,847 A | | 5/1984 | Owens | 131/365 |
| 4,452,259 A | | 6/1984 | Norman et al. | 131/349 |
| 4,453,553 A | | 6/1984 | Cohn | 131/365 |
| 4,489,738 A | | 12/1984 | Simon | 131/349 |
| 4,570,650 A | | 2/1986 | Sirota | 131/349 |
| 4,615,345 A | | 10/1986 | Durocher | 131/365 |
| 4,622,983 A | | 11/1986 | Mathews et al. | 131/365 |
| 4,679,575 A | | 7/1987 | Yamaguchi et al. | 131/365 |
| 4,739,755 A | | 4/1988 | White et al. | 128/206.12 |
| 4,776,355 A | | 10/1988 | Stevenson et al. | 131/352 |
| 4,781,203 A | | 11/1988 | La Hue | 131/79 |
| 4,889,145 A | * | 12/1989 | Adams et al. | 131/365 |
| 4,945,932 A | | 8/1990 | Mentzel et al. | 131/365 |
| 4,984,589 A | | 1/1991 | Riedesser | 131/365 |
| 4,991,595 A | | 2/1991 | Jones, Jr. | 131/175 |
| 4,998,542 A | | 3/1991 | Kallianos et al. | 131/365 |

(List continued on next page.)

FOREIGN PATENT DOCUMENTS

EP 93302732.8 7/1993

*Primary Examiner*—Cynthia H. Kelly
*Assistant Examiner*—B. Shewareged
(74) *Attorney, Agent, or Firm*—Nanda P.B.A. Kumar; Marc J. Farrell; ReedSmith LLP

(57) ABSTRACT

Novel materials for making low ignition propensity products are disclosed. Specifically, a treated cigarette paper for making low ignition propensity cigarettes are disclosed. The cigarette base paper containing a thermoplastic polymer aqueous suspension coated regions on a surface of the base paper so as to obtain coresta porosities of less than 15 is provided. This cigarette paper is further treated with a conditioning medium which is either water alone or water with a burning chemical such as an alkali metal containing organic salt either on the same surface bearing the thermoplastic polymer or on the opposite surface. The self-extinction characteristics of the cigarettes with the treated paper are improved. A method for making a cigarette paper for low ignition propensity cigarettes comprising a plurality of regions of a thermoplastic polymer aqueous suspension printed on to a surface of a base paper is also provided.

19 Claims, 2 Drawing Sheets

U.S. PATENT DOCUMENTS 5,060,675 A 10/1991 Milford et al. ..... 131/365
5,191,906 A 3/1993 Myracle, Jr. ..... 131/365
5,263,999 A 11/1993 Baldwin et al. ..... 131/365
5,342,484 A 8/1994 Cutright et al. ..... 162/139
5,360,516 A 11/1994 Cutright et al. ..... 162/139
5,417,228 A 5/1995 Baldwin et al. ..... 131/349
5,450,863 A 9/1995 Collins et al. ..... 131/365
5,474,095 A 12/1995 Allen et al. ..... 131/365
5,534,114 A 7/1996 Cutright et al. ..... 162/139
5,690,126 A * 11/1997 Matsumura et al. ..... 131/343
5,722,432 A 3/1998 Luke et al. ..... 131/349
5,722,433 A * 3/1998 Ishino et al. ..... 131/365
5,778,898 A 7/1998 Bae et al. ..... 131/349
5,820,998 A 10/1998 Hotaling et al. ..... 428/533
5,878,753 A 3/1999 Peterson et al. ..... 131/365
5,878,754 A 3/1999 Peterson et al. ..... 131/365
5,888,348 A 3/1999 Hampl, Jr. ..... 162/139
5,966,218 A 10/1999 Bokelman et al. ..... 131/15
5,997,691 A 12/1999 Gautam et al. ..... 162/134
6,020,969 A 2/2000 Struckhoff et al. ..... 356/430
6,129,087 A 10/2000 Wallace et al. ..... 131/339
6,198,537 B1 3/2001 Bokelman et al. ..... 365/429

* cited by examiner

MATERIALS AND METHOD OF MAKING SAME FOR LOW IGNITION PROPENSITY PRODUCTS

FIELD OF THE INVENTION

The present invention relates to low ignition propensity products and processes for making the same. Specifically, the present invention relates to products having one or more thermoplastic polymer aqueous suspension coated regions suitable for commercial use and methods of making such polymer suspensions printed products.

BACKGROUND OF THE INVENTION

Low ignition propensity products are desired for safety as well as regulatory reasons. The term low ignition propensity products as used herein refers to such products having specific coated regions such that, if lit, and upon contacting a combustible substrate, for example, have a tendency to self extinguish themselves when the burning front reaches a coated region in the product unless actuated by other means, when, for example, air is drawn on by the user in connection with smoking cigarettes; or held in a free burn state in which the burning product is sufficiently exposed to the air on all of its sides.

As to cigarettes, conventional cigarette papers (also referred to as base papers) that are currently being used as cigarette wrappers have high ignition propensity. This is so because the natural porosities of these conventional cigarette papers are high, in the order of 20 to 120 Coresta porosities At these Coresta porosities, oxygen permeability is high. Cigarettes using such papers as wrappers when lighted have a tendency to burn their entire length and may ignite a flammable object if left on the object unattended Coresta porosity is a term commonly used in the industry and is expressed by the unit cc/minute/cm$^2$ at 1 cbar pressure.

There have been various attempts, reported in the prior art, to modify the ignition propensity of the conventional cigarette papers. Some of these include polymer coatings particularly thermoplastic polymer coatings in the form of bands on the outer surface of the cigarette wrapper. However, these modified cigarette wrappers have various drawbacks.

For example, the thermoplastic polymers such as hydroxypropyl cellulose and ethyl cellulose have been applied to cigarette paper for the purpose of reducing cigarette burn rate. Although such wrappers can be used for making cigarettes with modified cigarette burn rate, these wrappers have organic solvent based polymer coatings not water based polymer coatings. Water based coatings have caused serious physical disruptions to the cigarette paper rendering it unusable for cigarette production. A justifiable interest exists in the cigarette industry to avoid organic solvent based polymers because such liquids or suspensions are not commercially feasible for use as an on-line process on the paper machine due to the problems of solvent fumes and fire hazards around paper machines and there is a significant risk of residual solvents remaining in the paper. Thus, use of organic solvents necessitates separate off-line printing process to make the modified cigarette paper. Other teachings disclose water dissolved hydroxypropyl cellulose coatings on the cigarette wrapper but they do not reduce the cigarette static burn rate.

Further, it has been reported that attempts to apply aqueous polymer solutions to the cigarette wrappers have been commercially unsuccessful because the aqueous solutions significantly reduce the strength of the paper, cause the paper to crinkle or pucker in the coated areas and the cigarettes made with these wrappers have a non-uniform and unappealing outer surface.

Thus, there is a need for use of products, including cigarettes having reduced burn rates and at the same time eliminating the reported problems of crinkling and puckering in the coated regions of the wrapper and/or paper.

SUMMARY OF THE INVENTION

The present invention provides products including cigarette papers containing a thermoplastic polymer aqueous suspension coated region(s) having reduced (Coresta) porosities suitable for making products with reduced burn rates. The invention uses high concentrations of thermoplastic polymer, enough to achieve sufficient paper porosity closure and hence cigarette burn rate retardation. The invention also provides ways to get sufficiently high enough concentrations of thermoplastic polymers into an aqueous vehicle at an low enough viscosity capable of being printed onto paper and/or wrappers via existing commercial printing techniques thus avoiding the cost of separate off-line converting processes and the problems of solvent fumes and fire hazards around paper machines.

The present invention also provides ways to eliminate the consequences due to the application of aqueous polymer solutions such as reducing the strength of the paper and also the paper crinkling or puckering in the coated areas.

In one aspect of the invention, a cigarette paper for making low ignition propensity cigarettes is provided. The cigarette paper has a base paper with a plurality of regions of thermoplastic polymer aqueous suspension printed on a surface of the paper. The aqueous suspension used as a printing ink does not have fibrous cellulose. The plurality of regions on the base paper have Coresta porosities of 0 to 14. The Coresta porosities of zero are achieved when all the pores in the coated region are sealed with the suspension. The cigarette paper also has a film of conditioning medium applied on to the surface containing the plurality of regions or on the opposite surface. The conditioning medium is water or water with a burning chemical. The thermoplastic polymer aqueous suspension has one or more thermoplastic polymers (such as hydroxypropyl cellulose, ethyl cellulose, ethyl hydroxyethyl cellulose, N-substituted acrylamides, poly(vinylmethylether), poly(ethylene oxide), poly (vinylalcohol) and poly(2-ethyl oxazoline), methyl cellulose ether, cellulose acetate, cellulose acetate phthalate, cellulose acetate butyrate) suspended in an aqueous medium but it has at least one thermoplastic polymer at concentrations greater than 10% w/w suspended in the aqueous medium. In one embodiment, the thermoplastic polymer aqueous suspension has ethyl cellulose at concentrations greater than 10% w/w suspended in the aqueous medium. In another embodiment, the thermoplastic polymer aqueous suspension has cellulose acetate phthalate at concentrations greater than 10% w/w suspended in the aqueous medium.

In another aspect of the invention a different type of cigarette paper for making low ignition propensity cigarettes is provided. The base paper here has a plurality of regions of hydroxypropyl cellulose aqueous suspension printed on a surface of the paper. The plurality of regions of the base paper have Coresta porosities from about 4 to about 10. The aqueous suspension has at least about 10% w/w hydroxypropyl cellulose. The aqueous suspension used as a printing ink does not have fibrous cellulose.

In still another aspect of the invention a different type of cigarette paper for making low ignition propensity cigarettes is provided. This cigarette paper has a base paper with a plurality of regions of thermoplastic polymer aqueous suspension printed on a surface of the paper. The aqueous suspension does not have fibrous cellulose but has only ethyl cellulose at a concentration of at least about 10% w/w and one other thermoplastic polymer (such as for example ethyl hydroxyethyl cellulose from about 0.3 to about 0.8% w/w). The plurality of regions on the base paper have Coresta porosities from about 1.5 to about 10.

In yet another aspect of the invention a different type of cigarette paper for making low ignition propensity cigarettes is provided. This cigarette paper has a base paper with a plurality of regions of thermoplastic polymer aqueous suspension printed on a surface of the paper and again the aqueous suspension does not have fibrous cellulose but has only cellulose acetate phthalate at a concentration of at least about 10% w/w and one other thermoplastic polymer and wherein the plurality of regions of the base paper have Coresta porosities from about 1.5 to about 10.

In a further aspect of the invention, a different type of cigarette paper is provided. This cigarette paper has a base paper with a plurality of regions of thermoplastic polymer, not of fibrous cellulose, aqueous suspension printed on a surface of the paper. The thermoplastic polymer aqueous suspension has one or more thermoplastic polymers suspended in an aqueous medium with at least one thermoplastic polymer at concentrations greater than 10% w/w suspended in the aqueous medium and wherein the plurality of regions of the base paper have Coresta porosities of 1 to 10. This cigarette paper also has a film of conditioning medium applied on to the surface containing the plurality of regions or the opposite surface thereof, wherein said conditioning medium is water or water with a burning chemical.

In a different aspect of the invention a composition for use as a printing ink to make low ignition propensity products comprising a thermoplastic polymer at concentrations from about 10% w/w to about 40% w/w suspended in an aqueous medium. The thermoplastic polymer is a cloud polymer or a room temperature polymer.

In another aspect of the invention a method for making a cigarette paper for low ignition propensity cigarettes with a plurality of regions of a thermoplastic polymer aqueous suspension printed on to a surface of a base paper is provided. The method includes the steps of advancing the base paper along a mechanical path so as to pass through a thermoplastic polymer aqueous suspension-printing station; and applying at said station, a thermoplastic polymer aqueous suspension to a surface of the base paper so as to form a plurality of regions containing said suspension. The plurality of regions on the base paper have Coresta porosities ranging from 0 to 14.9 or 0.1 to 14 or 0.5 to 10 or 1 to 10 or Coresta porosities ranging from about 1 to about 10. The method also includes an additional step of applying a uniform film of a conditioning medium to the surface of the base paper (or on the opposite side of the base paper) following the printing station application. The conditioning medium is water if the base paper used has a burning chemical or else the conditioning medium is water with a burning chemical. The thermoplastic polymer aqueous suspension-printing station is a heated or unheated size press rotogravure station.

DETAILED DESCRIPTION

Figure 1:
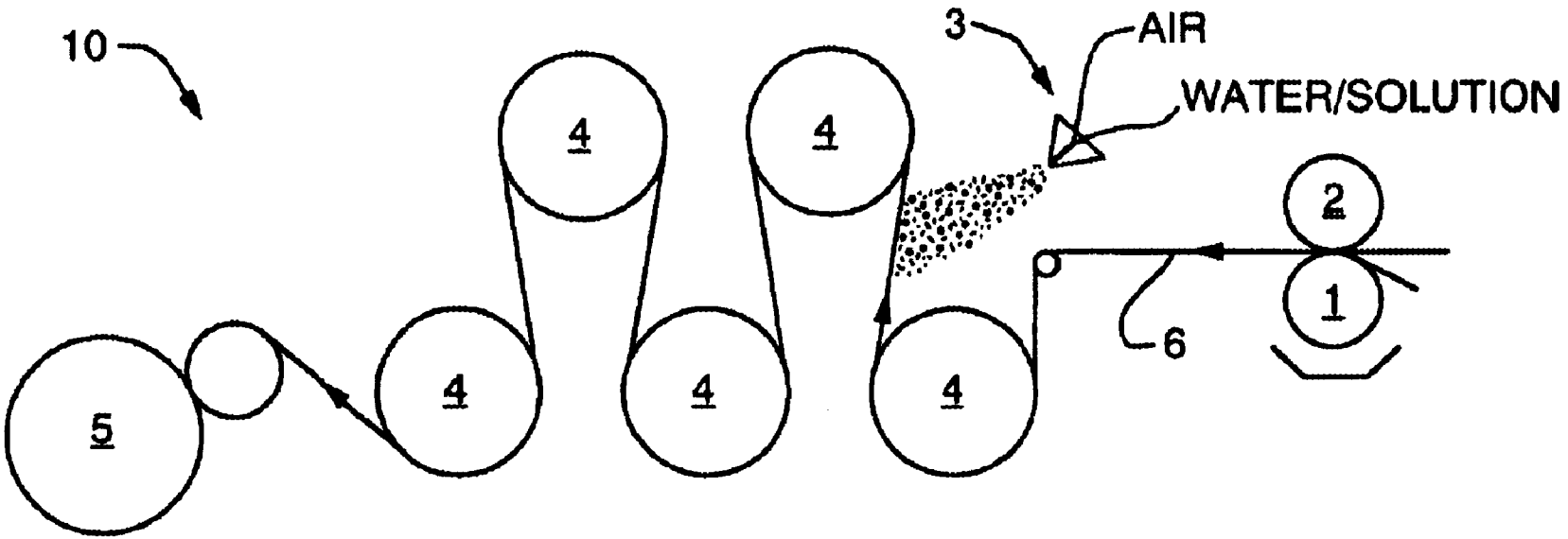
FIG. 1 is a schematic drawing of a pilot machine with the polymer printing station.

The present invention relates to low ignition propensity products having one or more thermoplastic polymer aqueous suspension coated regions and processes for making suitable polymer suspensions and products.

The specific embodiment disclosed herein is directed to cigarette papers treated with various polymers for use in low ignition propensity cigarettes. Disclosed also are processes for making such cigarette papers to make commercially feasible low ignition propensity cigarettes.

Some of the polymer materials used in the present invention have previously been shown to be ineffective for use in producing low ignition propensity cigarette wrappers, incapable of being done on paper machines via normal printing techniques and causing other problems rendering the paper not to be suitable for commercial processing.

The cigarette paper of the present invention has a thermoplastic polymer aqueous suspension printed on to a base paper. Thermoplastic polymers are those polymers that are capable of softening when heated and hardening when cooled. The base paper referred to herein is a conventional cigarette wrapper in use with natural Coresta porosities and ignition propensities (or burn rates). The thermoplastic polymer aqueous suspension treatments as disclosed herein lead to lower Coresta porosities and the lower ignition propensities of the paper.

There are a number of acceptable thermoplastic polymers for use in the present invention. Some are water soluble (e.g., hydroxypropyl cellulose) and some are water insoluble (e.g., ethyl cellulose). However, water soluble polymers can form highly viscous fluids at higher concentrations of the polymer rendering the solutions incapable of being printed by known methods. While rotogravure printing is used as a preferred printing method, other printing methods such as flexographic, ink jet, letter press and screen printing may also be used with further optimization. These methods are well known to one skilled in the art. Particularly contemplated thermoplastic polymers are those that form thixotropic, non-Newtonian fluids when suspended in an aqueous medium. Included in this category are both the room temperature aqueous suspensions and the higher temperature "cloud" polymer suspensions.

An important aspect of the invention is to have enough thermoplastic polymer(s) suspended in an aqueous medium without exceeding the workable viscosity range for using it as an ink for printing on to the base paper. High solid (polymer) concentrations, for example from 10% w/w to 40% w/w are preferred. However, it should be noted that aqueous solutions with higher concentrations of the polymer may not be capable of being printed via the art known printing methods because of highly viscous nature of the solution. On the other hand, the polymer aqueous solutions capable of being printed may not achieve sufficient paper porosity closure and thus may not be capable of reducing the burn rate of the cigarettes. For example, hydroxypropyl cellulose (HPC), a thermoplastic polymer, is a member of a class of polymers known as "cloud" polymers or "thermo-shrinking" polymers. At normal temperatures, HPC is soluble in water. As expected, the viscosity of HPC solutions increases quickly as the concentration of HPC is increased. At aqueous solution concentrations capable of being printed via the conventional printing method (e.g., rotogravure method), HPC is not capable of reducing the burn rate of the cigarettes and does not sufficiently close off the porosity of the paper. Concentrations of greater than about 10% w/w of HPC in water at room temperature are so viscous that the solution will not even flow. Therefore, additional steps would be necessary with such highly viscous polymer solutions to make them suitable for use as printable fluids.

What has not been previously recognized is that there are a number of polymers that show sharply contrasting behavior to the normal increasing solubility in water with increasing temperature. It is these types of polymers that allow use for application on cigarette papers. HPC is one such example of "cloud" polymers where the increase in temperature of this "cloud" polymer solution beyond a certain point, commonly referred to as the lower critical solution temperature (LCST) or flocculation or precipitation temperature, the polymer becomes insoluble and phase-separation occurs. At and above the LCST, the polymer is no longer in solution and the viscosity rapidly drops very dramatically into the range of viscosities that can be printed by the known methods. In the case of HPC this temperature begins at about 35° C. to 50° C.

Another example of "cloud" or "thermo-shrinking" polymers is ethyl hydroxyethyl cellulose (EHEC) having a LCST of 30° C. to 80° C. depending on the ratio of hydrophobic ethyl to hydrophilic ethylene oxide constituents. Other examples of acceptable "cloud" polymers are poly(N-isopropylacrylamide) and other N-substituted acrylamides, poly(vinylmethylether), poly(ethylene oxide), and certain grades of poly(vinylalcohol) and poly(2-ethyl oxazoline). Cellulose ethers, such as methyl hydroxyethyl cellulose and methyl hydroxypropyl cellulose, are also polymers that exhibit the critical flocculation temperature or LCST point where the gel collapses and the viscosity drops. The LCSTs of various thermoplastic polymers, particularly those specifically mentioned herein, are known to one skilled in the art.

As mentioned above ethyl cellulose is a member of the cellulose polymer family that is not water-soluble even at room temperatures. Such polymers are sometimes referred to herein as room temperature polymers as opposed to cloud polymers. Therefore, it has only been evaluated via non-aqueous solvents that can dissolve the ethyl cellulose. Furthermore, even via this approach, it is difficult to get enough EC into solution to achieve adequate coating levels to achieve sufficient paper porosity closure and, hence, cigarette burn rate retardation sufficient to cause cigarette extinction via the Whatman #2 Filter Pad test. It has now been discovered by the present inventors that it is possible to use submicron dispersions of EC in an aqueous vehicle to achieve adequate coating levels to achieve sufficient Coresta porosities for cigarette extinction. Such non-water soluble cellulosic polymers as submicron dispersions in water are commercially available. For example, AquaCoat ECD (the ethyl cellulose version with approximately 29% w/w EC solids) and AquaCoat CPD (a cellulose acetate phthalate version with approximately 26% w/w CAP solids) are available from FMC, Philadelphia, Pa. Preferred submicron suspensions (e.g., EC and CAP) should have polymer particle sizes ranging from $0.05\mu$ to $2.0\mu$ More preferred ranges are $0.1\mu$ to $1.5\mu$.

Other examples of the water insoluble polymers capable of being processed into a submicron aqueous dispersion are cellulose acetate and cellulose acetate butyrate.

Accordingly, disclosed herein are certain processing steps to obtain sufficiently high enough concentrations of thermoplastic polymers into an aqueous vehicle at a low enough viscosity capable of being applied onto cigarette paper via existing commercial printing techniques. Again referring to HPC, for example, it can be dissolved in water at the concentration of 25% w/w. At the normal temperatures of 20° C. to 30° C., this solution is so viscous that it cannot be even be poured out of the beaker let alone be tested for viscosity with the Brookfield instrument. But when this material is slowly heated from the normal temperatures to above about 37° C. the HPC begins to precipitate and the viscosity begins to drop to the point where the material can be stirred. Heating is continued until the temperature is brought up to 80° C. and the rate of stirring can be increased to create a very fine dispersion of precipitated HPC in water. At this point, the viscosity would be about 490 centipoise as measured by the Brookfield using spindle #2 at 100 rpm. This viscosity would not significantly change as the material cooled down until the temperature approached the LCST of 40° C. to 45° C. The mixture is then reheated to 65° C. only to insure that all regions of the suspension were above the LCST. This suspension is used to successfully print samples of cigarette paper via the heated size press rotogravure station (WRE#3 engraving). Although it is not necessary to reheat the suspension to exactly 65° C., it is preferred to keep the cloud polymer suspension of the invention adequately above the LCST to maintain all regions of the suspension above the LCST. These manipulations would also allow one to achieve sufficient paper porosity closure and thus reduced burn rate of the cigarettes. The viscosities of the suspensions for printing via known methods and achieving desired Coresta porosities can be from about 30 centipoise (cps) at the Brookfield viscosity, #2 spindle at 100 rpm to 3000 cps at Brookfield using spindle #2 at 10 rpm. More than one type of thermoplastic polymer can be used to make the polymer suspension. For example, the aqueous polymer suspension can have a cloud polymer as well as a room temperature polymer as long as at least one of the polymers is used at the preferred polymer concentrations sufficient to achieve low Coresta porosities. It is preferred to maintain viscosity ranges of 150 cps to 1000 cps, Brookfield spindel #2, 100 rpm while maintaining high concentrations of polymer(s) in the suspension. For example, room temperature polymers suspensions such as EC and CAP have low viscosities (about 40 cps, Brookfield spindle #2 at 100 rpm) even at the polymer concentration of about 25%. Although such polymer suspensions having viscosities as low as 30 cps at Brookfield spindle #2, 100 rpm can be used as a printing ink, it is preferable to increase the viscosity of the suspension to make a better quality print. One way to increase the viscosity of these room temperature polymer suspensions is to add a small amount of a water soluble polymer which may or may not be a cloud polymer. For example, the viscosity of EC and CAP aqueous suspensions can be increased dramatically simply by adding a small amount of EHEC to the aqueous suspensions of EC and CAP. Preferred viscosity ranges are 150 cps to 1000 cps as measured by the Brookfield instrument using spindle #2 at 100 rpm. Viscosity of the fluids can be measured by any of the suitable types of viscometers known in the art. Rotational viscometers such as a Brookfield Viscometer is one such example.

Therefore, by practicing the present invention, high concentrations of thermoplastic polymers or cellulose ethers in aqueous solutions can be used for printing on a surface of the base paper. It is desirable to print on the wire side of the paper rather than on the felt side of the paper.

In one embodiment of the invention, the thermoplastic polymer suspension treated areas of the base paper are such that the treated areas form series of bands separated by untreated areas. Typically, most brands of cigarettes have a circumference of about 25 mm. The width of the bands on cigarettes can be from 4 mm to 12 mm separated by 20 mm to 25 mm untreated areas. While the untreated areas can have Coresta porosities ranging from 20 to 120, the treated areas should have Coresta porosities less than 15. Preferred Coresta porosities are from about 0 to about 14.9. More preferred Coresta porosities are from about 0.1 to 14. Still more preferred Coresta porosities are from about 1 to 10.

It has been discovered here that one can eliminate the crinkling and puckering in polymer aqueous suspension coated areas of the material or paper with the appropriate addition of water to the material or paper following the printing station. A uniform film of water applied on the surface of the paper following the printing station generally eliminates the prior art reported problems. There are a number of known systems that can be used by one practicing the invention to control the pattern and quantity of water application to the printed paper. One such system is a hydraulic atomizing water nozzle, Spray Systems TEEJET 500017 that outputs 57 cc/min of water at 52 psi pressure. This spray can be directed to the printed paper on the same side as the print or on the opposite side of the print just before the paper entered the first dryer. However, it should be noted that it is not a requirement that the paper be re-wetted immediately following the print station and prior to the first dryer so long as the paper is re-wetted sufficiently to remove the cockles and wetted early enough in the process so that the paper is dry by the time it enters the wind-up reel. Another suitable spray system can be an air pressure atomizing water sprayer from Spray Systems (122440, 40100).

It is common in the cigarette paper industry to add burning chemicals such as alkali metal salts of weak organic acids such as citric acid, or alkali metal salts of the inorganic acid, phosphoric to the base paper. If the base paper had no burning chemical when it is made, one can add the burning chemical dissolved in water after the printing station by using a suitable spray system. Examples of controlled addition of water with burning chemical in conjunction with the high solids EC dispersion are samples JRH-1196 through JRH-1201 shown in Table 1. Water or water with burning chemicals can be added to the paper after the printing station by any of the known methods. Few such methods are a normal size press, a metering size press, high-voltage dispersing spray systems. Exposing the printed paper to steam can also solve the crinkling and puckering problems described above.

Thus, one can simultaneously achieve the necessary treatment of the cigarette paper for self-extinction or burn rate control with a process compatible with on-line equipment as part of a normal paper machine and produce paper products not heretofore possible with the combination of utilizing high solids aqueous vehicle rotogravure printing and judicious application of water following the printing station, to achieve the commercially desired low ignition propensity material or paper. While rotogravure method of printing is preferred, it should be understood that other methods of application of the thermoplastic polymer aqueous suspension should otherwise be acceptable provided they achieve the desired results.

Depicted in FIG. 1 is a schematic drawing of a pilot machine 10 with a print station and other attachments. The base paper to be printed with a thermoplastic polymer aqueous suspension passes through paper travel path 6, in between an engraved printing cylinder 1 and an impression roller 2. After printing of the suspension, the paper is passed through a series of dryers 4 before the paper is fed to a paper windup roll 5. Either before the printed paper enters the first dryer in the series or after the first dryer the paper is uniformly sprayed with water/solution using air atomizing water nozzle 3 to eliminate the crinkling and puckering of the paper after printing with the polymer suspension of the invention.

Figure 2:
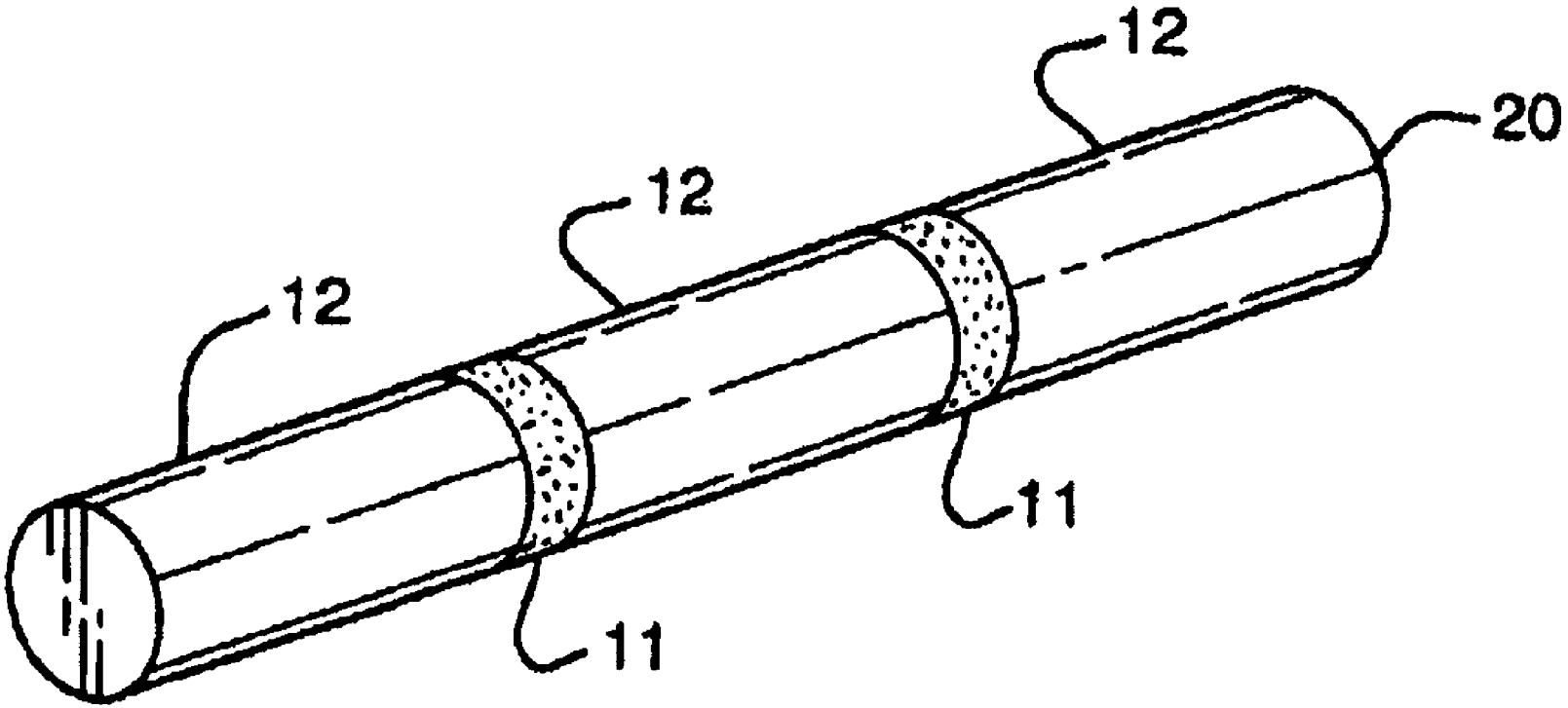
FIG. 2 is a perspective view of a cigarette with wrapping paper containing thermoplastic polymer printed areas (not drawn to the scale) to achieve reduced porosity of the paper in those areas.

Shown in FIG. 2 is a perspective view of a cigarette 20 with a wrapping paper containing thermoplastic polymer printed areas to achieve reduced porosity of the paper in those areas. The printed areas 11 are the regions that have reduced porosity. The areas without printed suspension 12 have original porosity.

EXAMPLES

The following examples further illustrate the present invention, however, should not be constructed as in any way limiting its scope. The examples below are carried out using standard techniques, that are well known and routine to those of skill in the art, except where otherwise described in detail.

Example 1

Demonstration of the Effect of Thermoplastic Polymer Treatments on the Coresta Porosities of Base Paper Shown in Table I are sample descriptions involving the aqueous dispersions of ethyl cellulose (EC) or cellulose acetate phthalate (CAP) with or without ethyl hydroxyethyl cellulose (EHEC). (EHEC is commercially available from Azo Nobel Surface Chemistry, Inc., Stratford, Conn. under the brand name Bermocol).

Cellulosic polymers are commercially available as submicron dispersions in water. They are AquaCoat ECD™, (the ethyl cellulose version with approximately 29% w/w EC solids) and AquaCoat CPD™, (a cellulose acetate phthalate version with applroximately 26% w/w CAP solids) both obtained from FMC, Philadelphia, Pa. The viscosities of these materials as received were tested and found to be 38 cps and 42 cps via the Brookfield #2 at 100 rpm respectively. Both of these materials were used to print samples of cigarette paper via the unheated size press rotogravure station (WRE#3 engraving).

All materials were printed on the wire side of the paper using WRE#3 engraving. Spray Systems air atomizing sprayer was used to condition the paper following the print station prior to the first dryer. Samples JRH-1196 through JRH-1201 additionally used citrate solution as the conditioning medium rather than plain tap water. Final citrate content in the paper was controlled by adjusting the rate of liquid feed through the sprayer. Samples JRH-1176, -1177, -1178 and -1179 were made to evaluate the effect of the treatments of ethyl cellulose (EC) or cellulose acetate phthalate (CAP) aqueous dispersions. All other samples in this series have various amounts of water and ethyl hydroxyethyl cellulose added for testing concentration and viscosity control for best printing. Adding small amounts of EHEC to the aqueous suspensions of EC or CAP greatly increased the viscosity of the suspensions which is beneficial for better quality printing from aqueous vehicles. The samples were tested for Coresta porosity. The results are shown in Table 1. The Coresta porosities achieved were less than 15. NT indicates samples that are not tested for a particular characteristic.

TABLE I

| Sample, JRH-# | Base Paper | Citrate % | Coresta Porosities Band | Coresta Porosities Space | Solids, % w/w in final make up EC | CAP | EHEC | Brookfield Viscosities, #2 spindle, CP 10 rpm | 20 rpm | 50 rpm | 100 rpm |
|---|---|---|---|---|---|---|---|---|---|---|---|
| 1176 | 12544 | 0.30 | 2.5 | 43.5 | 30.0 | 0.0 | 0.00 | NT | NT | NT | 38 |
| 1177 | 12760 | 0.85 | 2.0 | 23.4 | 30.0 | 0.0 | 0.00 | NT | NT | NT | 38 |
| 1180 | 12544 | 0.30 | 6.2 | 41.8 | 22.5 | 0.0 | 0.80 | NT | 350 | 224 | 182 |
| 1181 | 12760 | 0.85 | 1.5 | 22.2 | 22.5 | 0.0 | 0.80 | NT | 350 | 224 | 182 |
| 1187 | 12760 | 0.85 | 1.6 | 22.8 | 24.6 | 0.0 | 0.84 | 2840 | 1660 | 1220 | 760 |
| 1188 | 12750 | 0.93 | 4.0 | 52.3 | 24.6 | 0.0 | 0.84 | 2840 | 1660 | 1220 | 760 |
| 1189 | 12625 | 0.55 | 6.8 | 74.0 | 24.6 | 0.0 | 0.84 | 2840 | 1660 | 1220 | 760 |
| 1196 | 99891 | 0.58 | 5.5 | 42.9 | 28.8 | 0.0 | 0.37 | 1120 | 660 | 364 | 244 |
| 1197 | 99891 | 0.46 | 5.8 | 42.5 | 28.8 | 0.0 | 0.37 | 1120 | 660 | 364 | 244 |
| 1198 | 99891 | 0.22 | 5.5 | 42.0 | 28.8 | 0.0 | 0.37 | 1120 | 660 | 364 | 244 |
| 1199 | 99461 | 0.18 | 9.5 | 60.1 | 28.8 | 0.0 | 0.37 | 1120 | 660 | 364 | 244 |
| 1200 | 99461 | 0.31 | 7.0 | 61.0 | 28.8 | 0.0 | 0.37 | 1120 | 660 | 364 | 244 |
| 1201 | 99461 | 0.52 | 7.8 | 56.8 | 28.8 | 0.0 | 0.37 | 1120 | 660 | 364 | 244 |
| 1178 | 12544 | 0.30 | 3.0 | 44.5 | 0.0 | 27.0 | 0.00 | NT | NT | NT | 42 |
| 1179 | 12760 | 0.85 | 1.6 | 23.0 | 0.0 | 27.0 | 0.00 | NT | NT | NT | 42 |
| 1182 | 12544 | 0.30 | 3.7 | 43.0 | 0.0 | 24.5 | 0.80 | 1400 | 920 | 560 | 396 |
| 1183 | 12760 | 0.85 | 1.3 | 21.9 | 0.0 | 24.5 | 0.80 | 1400 | 920 | 560 | 396 |
| 1184 | 12760 | 0.85 | 1.1 | 22.4 | 0.0 | 24.6 | 0.86 | 1320 | 870 | 528 | 380 |
| 1185 | 12750 | 0.93 | 2.7 | 48.8 | 0.0 | 24.6 | 0.86 | 1320 | 870 | 528 | 380 |
| 1186 | 12625 | 0.55 | 7.7 | 86.7 | 0.0 | 24.6 | 0.86 | 1320 | 870 | 528 | 380 |

Example 2

Demonstration of Ethyl Cellulose or Cellulose Acetate Phthalate Aqueous Suspension as Suitable Polymers for Treating Cigarette Papers Shown in Table II are ignition propensity testing results of the source samples shown in Table I. The samples in Table I were used as the cigarette wrapper. Two brands of cigarettes, Brand A and Brand B were made. The samples were tested for free static burning and filter pad extinction. A majority of the samples tested showed satisfactory self-extinction via the Whatman #2 Filter Pad test. Free burn rates for Brand A Control ranged about 54 mg/minute with no extinctions. Free burn rates for Brand B control ranged from about 51 to 60 mg/minutes with no extinctions. Controls used here had no polymer suspension treated areas.

Presented in Table II are burning and extinction tests conducted on Brand A and Brand B cigarettes and the results are the average of three cigarettes for each brand. Note: Free burn rates are for cigarettes held in the horizontal position without contacting any physical article. Free burn rate is the common method reported as mg of tobacco section burnt per minute. Pad burn is the test, proposed by the National Institute of Standards and Testing (NIST), also known as the Whatman #2 Filter Paper Pad Extinction test. This proposed test stipulates that cigarettes will pass if 50% or more of the cigarettes are extinguished. In general, Brand B cigarette was known to be difficult to distinguish. Considering this fact, the pad burn extinction achieved was highly significant. NT indicates samples not test for a particular characteristic.

TABLE II

| Sample | Cigarette Brand | Free Burn mg/min. | Pad Burn % extinction | Cigarette Brand | Free Burn Mg/min. | Pad burn % extinction |
|---|---|---|---|---|---|---|
| 1176 | A | 50.54 | 100 | NT | NT | NT |
| 1177 | A | 57.62 | 100 | B | 46.99 | 0 |
| 1180 | A | 50.31 | 100 | B | 49.68 | 0 |
| 1181 | A | 54.56 | 100 | B | 51.16 | 100 |
| 1187 | A | 52.42 | 100 | B | 51.96 | 67 |
| 1188 | A | 56.08 | 67 | B | 60.61 | 33 |
| 1189 | A | 56.10 | 0 | B | 57.66 | 67 |
| 1196 | A | 52.60 | 100 | B | 51.52 | 100 |
| 1197 | NT | NT | NT | NT | NT | NT |
| 1198 | A | 48.34 | 100 | B | 44.32 | 100 |
| 1199 | A | 48.80 | 67 | B | 46.82 | 33 |
| 1200 | NT | NT | NT | NT | NT | NT |
| 1201 | A | 53.49 | 100 | B | 52.26 | 100 |
| 1178 | A | 50.45 | 100 | NT | NT | NT |
| 1179 | NT | NT | NT | NT | NT | NT |
| 1182 | A | Extinguished | NT | NT | NT | NT |
| 1183 | NT | NT | NT | NT | NT | NT |
| 1184 | A | Extinguished | NT | B | Extinguished | NT |
| 1185 | A | 52.98 | 100 | B | 51.77 | 100 |
| 1186 | A | 55.82 | 100 | B | 50.36 | 100 |

Description of Results

Example 3

Demonstration of HPC as a Suitable Thermoplastic Polymer for Treating the Base Papers The printing ink was prepared by dispersing hydroxypropyl cellulose Hercules Aqualon Klucel J grade) into warm, 40° C. to 45° C., water until the concentration was 25% w/w HPC. The mixture was allowed to cool until the temperature approached the LCST point of about 37° C. At this time, the stirring was turned off and the HPC allowed to dissolve and hydrate overnight. The next morning, the solution was so thick that it could not be poured or even removed from the beaker. As the mixture was re-heated, the HPC began to precipitate and cloud; at this point stirring was begun. In the temperature range of 60° C. to 80° C., the mixture was milky white with precipitated HPC and the Brookfield viscosity was 490 cps (#2 spindle, 100 rpm). The rotogravure station on the Pilot Size Press was preheated to 65° C. with hot water, water drained and the warm 65° C. HPC mix added to the pan. Standard Reference papers 12760, 12750 and 12625 were then printed on the wire side using WRE#3 engraving with the air atomizing spray operated with tap water. Sample results are shown below in Table III.

TABLE III

| Sample JRH-# | Base Paper Reference | Coresta Porosities Band | Coresta Porosities Space | Brand A cigarette burn Free mg/min | Brand A cigarette burn Pad % extinct | Brand B cigarette burn Free mg/min | Brand B cigarette burn Pad % extinct |
|---|---|---|---|---|---|---|---|
| -1205 | 12760 | 4.4 | 22.9 | 53.13* | 100 | 57.87* | 100 |
| -1206 | 12750 | 9.8 | 59.4 | 64.18 | 100 | 61.20 | 100 |
| -1207 | 12625 | 19.8 | 86.6 | NT | NT | NT | NT |

*One cigarette out of three self-extinguished in the free burn mode.

While this invention has been described with a reference to specific embodiments, it will be obvious to those of ordinary skill in the art that variations in these methods and compositions may be used and that it is intended that the invention may be practiced otherwise than as specifically described herein. Accordingly, this invention includes all modifications encompassed within the spirit and scope of the invention as defined by the claims.

What is claimed is:

1. A cigarette paper for making low ignition propensity cigarettes comprising a base paper with a plurality of regions of thermoplastic polymer aqueous suspension printed on a surface of the paper wherein the plurality of regions of the base paper have Coresta porosities of 0 to 14.9, wherein said thermoplastic polymer aqueous suspension has one or more thermoplastic polymers suspended in an aqueous medium and has at least one thermoplastic polymer at concentrations greater than 10% w/w suspended in the aqueous medium, wherein said thermoplastic polymer is selected from the group consisting of: methyl cellulose ether, ethyl hydroxyethyl cellulose, N-substituted acrylamides, poly(vinylmethylether), poly(ethylene oxide), poly(2-ethyl oxazoline), methyl cellulose ether, cellulose acetate, cellulose acetate phthalate and cellulose acetate butyrate wherein said methyl cellulose ether is methyl hydroxyethyl cellulose or methyl hydroxypropyl cellulose.

2. The cigarette paper of claim 1, wherein said thermoplastic polymer is ethyl hydroxyethyl cellulose.

3. A cigarette paper for making low ignition propensity cigarettes comprising a base paper with a plurality of regions of thermoplastic polymer aqueous suspension printed on a surface of the paper wherein the plurality of regions of the base paper have Coresta porosities of 0 to 14.9, wherein said thermoplastic polymer aqueous suspension has one or more thermoplastic polymers suspended in an aqueous medium and has at least one thermoplastic polymer at concentrations greater than 10% w/w suspended in the aqueous medium, wherein said at least one thermoplastic polymer is cellulose acetate phthalate.

4. A cigarette paper for making low ignition propensity cigarettes comprising a base paper with a plurality of regions of thermoplastic polymer aqueous suspension printed on a surface of the paper, where in said aqueous suspension does not have fibrous cellulose, but has ethyl cellulose at a concentration of at least about 10% w/w and one other thermoplastic polymer and wherein the plurality of regions of the base paper have Coresta porosities from about 1.5 to about 10.

5. The cigarette paper of claim 4, wherein said aqueous suspension has ethyl hydroxyethyl cellulose as said one other thermoplastic polymer.

6. The cigarette paper of claim 5, wherein said aqueous suspension has ethyl hydroxyethyl cellulose from about 0.3 to about 0.8% w/w.

7. A cigarette paper for making low ignition propensity cigarettes comprising a base paper with a plurality of regions of thermoplastic polymer aqueous suspension printed on a surface of the paper, where in said aqueous suspension does not have fibrous cellulose, but has cellulose acetate phthalate at a concentration of at least about 10% w/w and one other thermoplastic polymer and wherein the plurality of regions of the base paper have Coresta porosities from about 1.5 to about 10.

8. The cigarette paper of claim 7, wherein said aqueous suspension has ethyl hydroxyethyl cellulose as said one other thermoplastic polymer.

9. The cigarette paper of claim 8, wherein said aqueous suspension has ethyl hydroxyethyl cellulose from about 0.3 to about 0.8% w/w.

10. The cigarette paper of claim 1, wherein said thermoplastic polymer is N-substituted acrylamides.

11. The cigarette paper of claim 1, wherein said thermoplastic polymer is poly(vinylmethylether).

12. The cigarette paper of claim 1, wherein said thermoplastic polymer is poly(ethylene oxide).

13. The cigarette paper of claim 1, wherein said thermoplastic polymer is poly(2-ethyl oxazoline).

14. The cigarette paper of claim 1, wherein said thermoplastic polymer is methyl cellulose ether.

15. The cigarette paper of claim 1, wherein said thermoplastic polymer is cellulose acetate.

16. The cigarette paper of claim 1, wherein said thermoplastic polymer is cellulose acetate phthalate.

17. The cigarette paper of claim 1, wherein said thermoplastic polymer is cellulose acetate butyrate.

18. The cigarette paper of claim 1, wherein said thermoplastic polymer is methyl hydroxyethyl cellulose.

19. The cigarette paper of claim 1, wherein said thermoplastic polymer is methyl hydroxypropyl cellulose.

* * * * *